US009277827B2

(12) United States Patent
Hornbach et al.

(10) Patent No.: US 9,277,827 B2
(45) Date of Patent: Mar. 8, 2016

(54) MATTRESS DEFLATION MANAGEMENT

(71) Applicant: Hill-Rom Services, Inc., Batesville, IN (US)

(72) Inventors: David W. Hornbach, Brookville, IN (US); Jonathan D. Turner, Dillsboro, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 60 days.

(21) Appl. No.: 14/093,881

(22) Filed: Dec. 2, 2013

(65) Prior Publication Data

US 2014/0082849 A1 Mar. 27, 2014

Related U.S. Application Data

(63) Continuation of application No. 12/963,026, filed on Dec. 8, 2010, now Pat. No. 8,595,873.

(51) Int. Cl.

| | |
|---|---|
| ***A47C 27/10*** | (2006.01) |
| ***A47C 27/08*** | (2006.01) |
| ***A61G 7/015*** | (2006.01) |
| ***A61G 7/053*** | (2006.01) |
| ***A61G 7/16*** | (2006.01) |
| *A61G 5/14* | (2006.01) |
| *A61G 7/057* | (2006.01) |

(52) U.S. Cl.

CPC ..... *A47C 27/083* (2013.01); *A61G 7/015* (2013.01); *A61G 7/053* (2013.01); *A61G 7/16* (2013.01); *A61G 5/14* (2013.01); *A61G 7/05769* (2013.01)

(58) Field of Classification Search

CPC ..... A47C 27/10

USPC ..... 5/706–707, 710, 713, 722–723

See application file for complete search history.

(56) References Cited

U.S. PATENT DOCUMENTS

| | | | | |
|---|---|---|---|---|
| 3,251,075 | A | 5/1966 | Saltness, Jr. | |
| 5,177,821 | A | 1/1993 | Kawtoski | |
| 5,454,126 | A | 10/1995 | Foster et al. | |
| 5,630,238 | A | 5/1997 | Weismiller et al. | |
| 5,652,985 | A | 8/1997 | Wilkinson et al. | |
| 5,666,681 | A | 9/1997 | Meyer et al. | |
| 5,692,256 | A | 12/1997 | Kramer et al. | |
| 5,715,548 | A | 2/1998 | Weismiller et al. | |
| 5,724,685 | A | 3/1998 | Weismiller et al. | |
| 5,729,853 | A * | 3/1998 | Thompson | 5/713 |
| 5,745,937 | A | 5/1998 | Weismiller et al. | |
| 5,781,949 | A | 7/1998 | Weismiller et al. | |
| 5,940,910 | A | 8/1999 | Weismiller et al. | |

(Continued)

FOREIGN PATENT DOCUMENTS

| | | |
|---|---|---|
| GB | 2231790 A | 11/1990 |
| WO | 2010132931 A1 | 11/2010 |

OTHER PUBLICATIONS

European Search Report for EP Application No. 11192326.4, dated Dec. 12, 2012.

*Primary Examiner* — Fredrick Conley

(74) *Attorney, Agent, or Firm* — Barnes & Thornburg LLP

(57) ABSTRACT

A patient support apparatus includes an inflatable support structure that varies in size as a frame of the patient support apparatus varies in size. The inflatable support structure includes a bladder assembly and bias members that urge the bladder assembly to a collapsed configuration during deflation of the bladder assembly.

20 Claims, 5 Drawing Sheets

(56) References Cited

U.S. PATENT DOCUMENTS

| | | | |
|---|---|---|---|
| 6,141,806 | A | 11/2000 | Bobey et al. |
| 6,151,739 | A | 11/2000 | Meyer et al. |
| 6,163,903 | A | 12/2000 | Weismiller et al. |
| 6,212,714 | B1 | 4/2001 | Allen et al. |
| 6,269,505 | B1 | 8/2001 | Wilkinson |
| 6,336,235 | B1 | 1/2002 | Ruehl |
| 6,351,863 | B1 | 3/2002 | Meyer et al. |
| 6,496,993 | B2 | 12/2002 | Allen et al. |
| 6,499,167 | B1 | 12/2002 | Ellis et al. |
| 6,584,628 | B1 | 7/2003 | Kummer et al. |
| 6,684,427 | B2 | 2/2004 | Allen et al. |
| 6,694,556 | B2 | 2/2004 | Stolpmann |
| 6,922,863 | B2 | 8/2005 | Giori et al. |
| 7,000,272 | B2 | 2/2006 | Allen et al. |
| 7,017,208 | B2 | 3/2006 | Weismiller et al. |
| 7,076,818 | B2 | 7/2006 | Kummer et al. |
| 7,086,107 | B2 | 8/2006 | Ellis et al. |
| 7,213,279 | B2 | 5/2007 | Weismiller et al. |
| 7,216,384 | B2 | 5/2007 | Allen et al. |
| 7,216,389 | B2 | 5/2007 | Ellis et al. |
| 7,325,265 | B2 | 2/2008 | Hornbach et al. |
| 7,353,557 | B2 | 4/2008 | Ellis et al. |
| 7,451,506 | B2 | 11/2008 | Kummer et al. |
| 7,469,436 | B2 | 12/2008 | Meyer et al. |
| 7,520,006 | B2 | 4/2009 | Menkedick et al. |
| 7,523,515 | B2 | 4/2009 | Allen et al. |
| 7,669,263 | B2 | 3/2010 | Menkedick et al. |
| 7,681,270 | B2 | 3/2010 | Wyatt et al. |
| 7,685,664 | B2 | 3/2010 | Stolpmann et al. |
| 7,757,318 | B2 | 7/2010 | Poulos et al. |
| 7,802,332 | B2 | 9/2010 | Kummer et al. |
| 7,937,791 | B2 | 5/2011 | Meyer et al. |
| 7,975,335 | B2 | 7/2011 | O'Keefe et al. |
| 2002/0016995 | A1 | 2/2002 | Cook |
| 2005/0273941 | A1 | 12/2005 | Stolpmann et al. |
| 2007/0266494 | A1* | 11/2007 | DeLuca et al. ..... 5/81.1 R |
| 2009/0049617 | A1 | 2/2009 | Chaffee |
| 2009/0260639 | A1 | 10/2009 | Hsu et al. |
| 2010/0306924 | A1 | 12/2010 | Kummer et al. |
| 2010/0325810 | A1 | 12/2010 | Dahlin et al. |

* cited by examiner

MATTRESS DEFLATION MANAGEMENT

RELATED APPLICATIONS

This application is a continuation of U.S. patent application Ser. No. 12/963,026, filed Dec. 8, 2010, now U.S. Pat. No. 8,595,873, which is incorporated herein by this reference.

BACKGROUND

The present disclosure is related to patient support apparatuses including inflatable mattresses. More specifically, the present disclosure is related to a patient support apparatus having an inflatable mattress that varies in size during movement of the patient support apparatus to a chair egress position.

Patient support apparatuses, such as hospital beds, for example, may include deck sections that are expandable or retractable to vary the size of the deck section. For example, a patient support apparatus may include a deck section to support the lower legs with the foot deck section being extendable or retractable to act as a foot prop to support the foot of a patient on the patient support apparatus. In patient support apparatuses that move to a chair egress position, such as the Hill-Rom® TotalCare® bed, the foot deck section may retract to prevent interference with the floor when the foot deck section is lowered to a generally vertical position.

When a hospital bed moves to a chair egress position, the leg portion of the mattress of the hospital bed may present interference for the legs of a patient during the egress process. Mattresses also must be reduced in size during retraction of the leg portion of the bed. In the case of inflatable mattresses, the mattress may be deflated to reduce the size of the mattress. Material of the mattress sometimes sags to the floor due to the lack of support provided by air in the leg portion of the mattress when the leg portion is deflated.

SUMMARY

The present application discloses one or more of the features recited in the appended claims and/or the following features which, alone or in any combination, may comprise patentable subject matter.

According to the present disclosure, a patient support apparatus includes a source of pressurized air, an inflatable support structure, and a retraction management system. The inflatable support structure includes a bladder assembly in fluid communication with the source of pressurized air. The retraction management system includes a bias member acting on the inflatable support structure in equilibrium with the bladder assembly to control the size and position of the inflatable support structure during inflation and deflation of the bladder assembly.

In some embodiments, the patient support apparatus further includes a controller to control the source of pressurized air to vary the pressure in the bladder assembly.

The bladder assembly may have a length, a width, and a depth. The retraction management system may include an elastic material which acts on the bladder assembly to minimize the depth dimension. The retraction management system may also act on the bladder assembly to minimize the length dimension.

In some embodiments, a bias member of the retraction management system passes through an aperture formed in a bladder of the bladder assembly. The retraction management system may further include an anchor coupled to a first end of the bias member that passes through the aperture formed in a bladder of the bladder assembly. The retraction management system may further include a retainer coupled to a second end of the bias member. The bias member may urge the retainer against the bladder with the retainer urged toward the anchor to control the position and size of the bladder during inflation and deflation of the bladder.

In some embodiments, the bladder assembly includes a plurality of adjacent bladders and the bias member passes through an aperture formed in each respective bladder. The retainer is urged against a first one of the bladders with the first bladder acting on an adjacent bladder. Each successive bladder acts on an adjacent bladder to control the position and size of the bladder assembly during inflation and deflation of the bladder assembly.

In some embodiments, each of the bladders is formed with a plurality of apertures such that the apertures in each bladder align with the apertures in adjacent bladders to form a path through the plurality of bladders. The retraction management system may include a plurality of bias members, each of the bias members passing through a separate path formed in the plurality of bladders. Each of the bias members may be coupled to an anchor and a retainer, each retainer acting on the bladder assembly to control the position and size of the bladder assembly during inflation and deflation of the bladder assembly.

In some embodiments, the patient support apparatus further includes a variable length deck section having an actuator that extends and retracts to vary the length of the deck section and a controller coupled to the source of pressurized and the actuator. The controller coordinates the inflation and deflation of the bladder assembly with the extension and retraction of the actuator.

The retraction management system may further include a depth control assembly acting on the bladder assembly to manage the depth of the bladder assembly during inflation and deflation of the bladder assembly. The depth control assembly may include an upper retainer that overlies the bladder assembly and a pair of bias members positioned on opposite lateral sides of the bladder assembly. The bias members urging the upper retainer to engage the bladder assembly to control the depth of the bladder assembly by maintaining equilibrium between the force exerted by the pressure in the bladder assembly and the force exerted by the depth control assembly.

In some embodiments, the bias members of the depth control assembly are each secured at one end to the upper retainer and at an opposite end to the deck.

The depth control assembly may further include a lower retainer. The bias members may each be secured at one end to the upper retainer and secured at the other end to the lower retainer. The bias members then urge the retainers together to control the depth of the bladder assembly by maintaining equilibrium between the force exerted by the pressure in the bladder assembly and the force exerted by the depth control assembly.

BRIEF DESCRIPTION OF THE DRAWINGS

The detailed description particularly refers to the accompanying figures, in which.

DETAILED DESCRIPTION OF THE DRAWINGS

Figure 1:
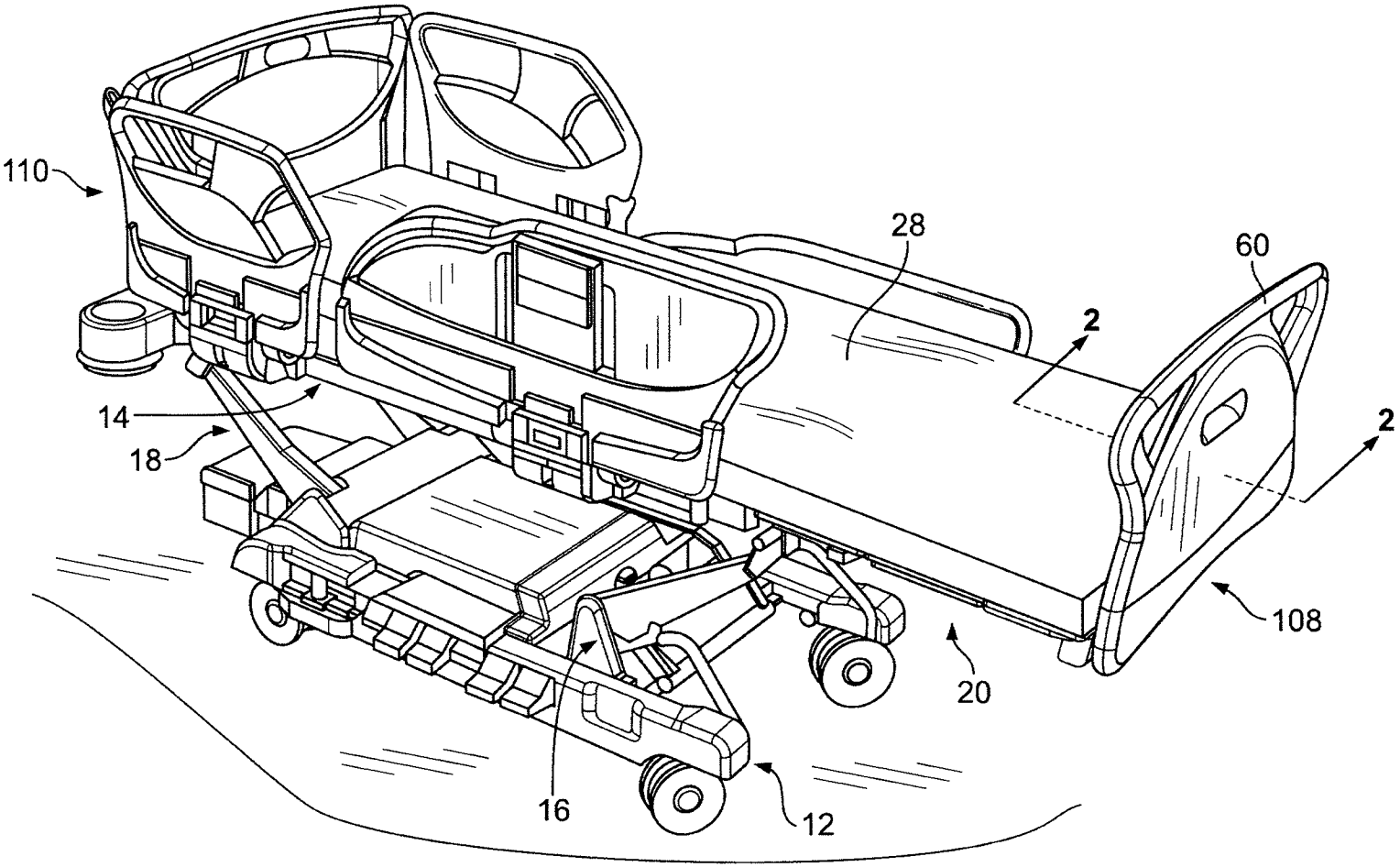
FIG. 1 is a perspective view of a patient support apparatus including a foot deck section that is extendable and retractable, the patient support apparatus movable to a chair egress position.
Figure 3:
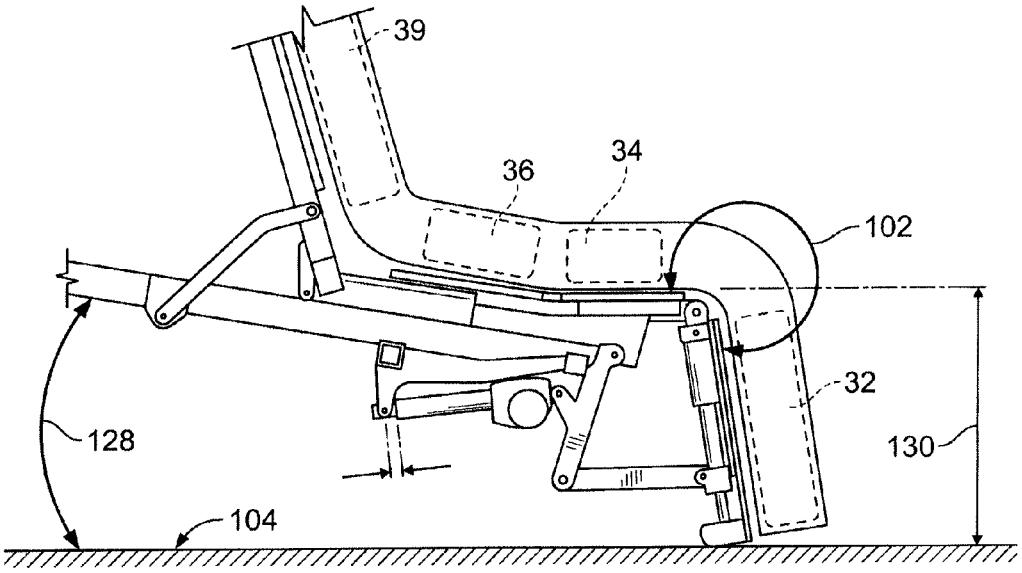
FIG. 3 is a view similar to FIG. 2 with the foot deck section lowered and retracted, the leg portion of a mattress of the patient support apparatus collapsed.
Figure 4:
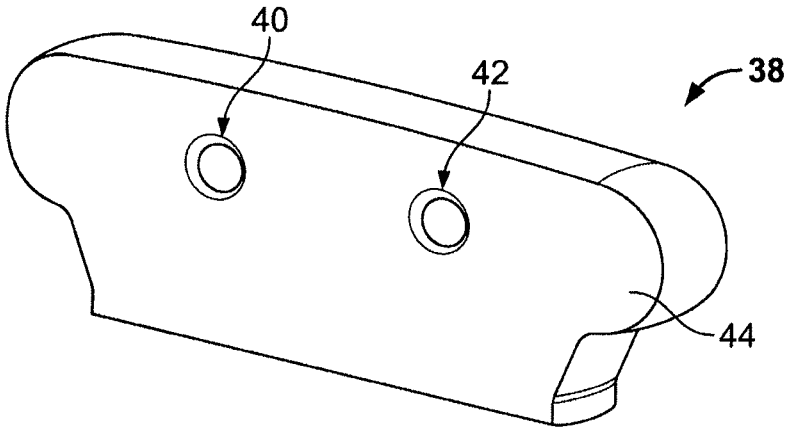
FIG. 4 is a perspective view of a bladder including two apertures formed in the body of the bladder.

A patient support apparatus, illustratively embodied as a hospital bed 10 shown in FIG. 1, includes a lower frame 12 and an upper frame 14 movable relative to the lower frame 12. The upper frame 14 is supported on two pairs of lift arms 16 and 18, respectively. The lift arms 16 are positioned generally at a foot end 108 of the lower frame 12 and the lift arms 18 are positioned generally at a head end 110 of the lower frame 12. Reference to the foot end 108 and the head end 110 of the hospital bed 10 is intended to provide an orientation reference and does not refer to any specific surface or element of the hospital bed 10. The hospital bed 10 of FIG. 1 is movable from a horizontal bed position as shown in FIG. 1 to a chair egress position in which the foot deck section 20 of the hospital bed 10 is lowered to a generally vertical position as shown in FIG. 3. The patient supported on the hospital bed 10 may egress or exit the hospital bed 10 from the foot end 108 of the hospital bed 10 in a seated position.

Figure 2:
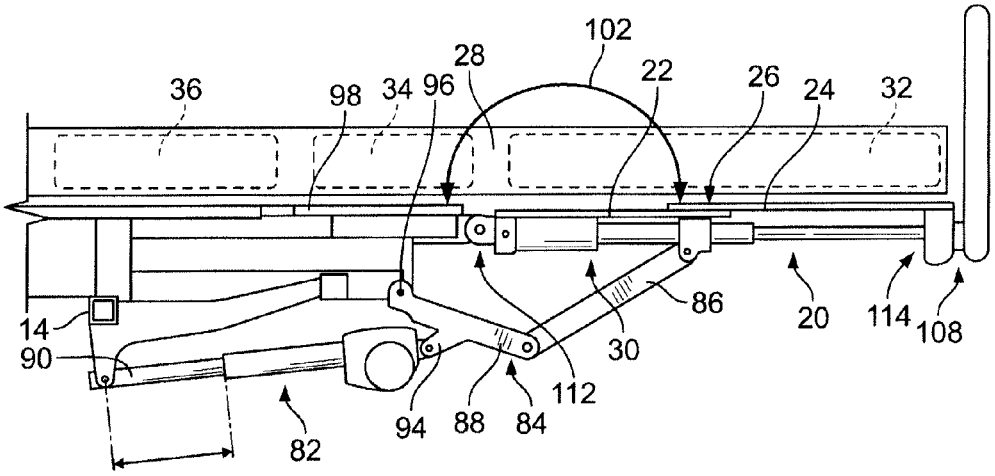
FIG. 2 is a side view of a portion of the patient support apparatus of FIG. 1 with the foot deck section in a raised position.

As shown in FIGS. 2-3, the foot deck section 20 of the hospital bed 10 includes a base 22 and an extender 24 movable relative to the base 22 to vary the length of the foot deck section 20. The foot deck section 20 defines a support surface 26 which supports at least a portion of a mattress 28. The support surface 26 is variable in size and increases in size as the extender 24 moves relative to the base 22 to increase the length of the foot deck section 20. The extender 24 is supported from the base 22 and movable relative to base 22 between a fully extended position as shown in FIG. 1 and a retracted position as shown in FIG. 3.

Referring now to FIG. 2, the foot deck section 20 changes in length when acted on by an actuator 30 that is connected at a first end 112 to the base 22 of the foot deck section 20. A second end 114 of the actuator 30 is connected to the extender 24. The actuator 30 extends and retracts the foot deck section 20 to vary the length of the foot deck section 20 and the size of the support surface 26.

Extension and retraction of the foot deck section 20 may be used to modify the length of the hospital bed 10 to accommodate patients of different heights, or may be used to retract the foot deck section 20 when the foot deck section 20 is moved to the generally vertical position as shown in FIG. 3. As shown in FIGS. 2 and 3, the foot deck section 20 is supported on the upper frame 14 and pivotal relative to the upper frame 14. A linear actuator 82 rotates a crank 84 which supports the foot deck section 20 through an arm 86 which is pivotally coupled to the foot deck section 20 and a link 88 of the crank 84. The linear actuator 82 includes a rod 90 which extends and retracts relative to a body 92, with the actuator 82 acting on a link 94 of the crank 84 which causes the crank to rotate about an axis 96. Operation of the linear actuator 82 causes the foot deck section 20 to move relative to a thigh deck section 98 such that a surface 100 of the thigh deck section 98 and the surface 26 of the foot deck section 20 form a variable angle 102. The angle 102 between surface 26 and surface 100 is variable between a straight angle being formed between the surfaces 26 and 100 when the foot deck section 20 is in a position to support a patient in a supine position on the hospital bed 10. As shown in FIG. 3, the angle 102 may be as great as approximately 270° when the foot deck section 20 is lowered to position the hospital bed 10 in the chair egress position. In the chair egress position shown in FIG. 2, the foot deck section 20 is fully retracted to reduce the height 130 of the thigh deck section 98 from the floor 104 when the upper frame 14 is lowered to the chair egress position.

The upper frame 14 is tiltable relative to the floor 104 to increase form an angle 128 of at least about 7°. In some embodiments, the angle 128 could be at least as much as 15°. In this attitude, the thigh deck section 98 is positioned approximately horizontally as shown in FIG. 3 to form the chair egress position. With the foot deck section 20 fully retracted, the height 130 is reduced to provide a position for a patient to egress from the foot end 108 of the hospital bed 10.

Referring now to FIG. 2, the mattress 28 includes a foot section bladder assembly 32, a thigh section bladder assembly 34, and a seat section bladder assembly 36. The mattress 28 also includes a head section bladder assembly 39 as shown in FIG. 3. Referring to the difference between the mattress 28 in FIG. 2 as compared to the mattress 28 in FIG. 3, it can be seen that the thigh section bladder assembly 34 and the foot section bladder assembly 32 each experience some level of deflation in the hospital bed 10 transitions from the horizontal bed position of FIG. 1 to the chair egress position of FIG. 3. For example, deflation of the foot section bladder assembly 32 reduces the interference of the foot section bladder assembly 32 with a patient who attempts to egress from the foot and 108 of the hospital bed 10. The deflation of the foot section bladder assembly 32 present a challenge in the management of the mattress structure in the area of the foot section bladder assembly 32 because the deflation results in excess material that is normally used to cover the foot section bladder assembly 32 sagging and potentially providing a trip hazard for a patient exiting the hospital bed 10.

Figure 5:
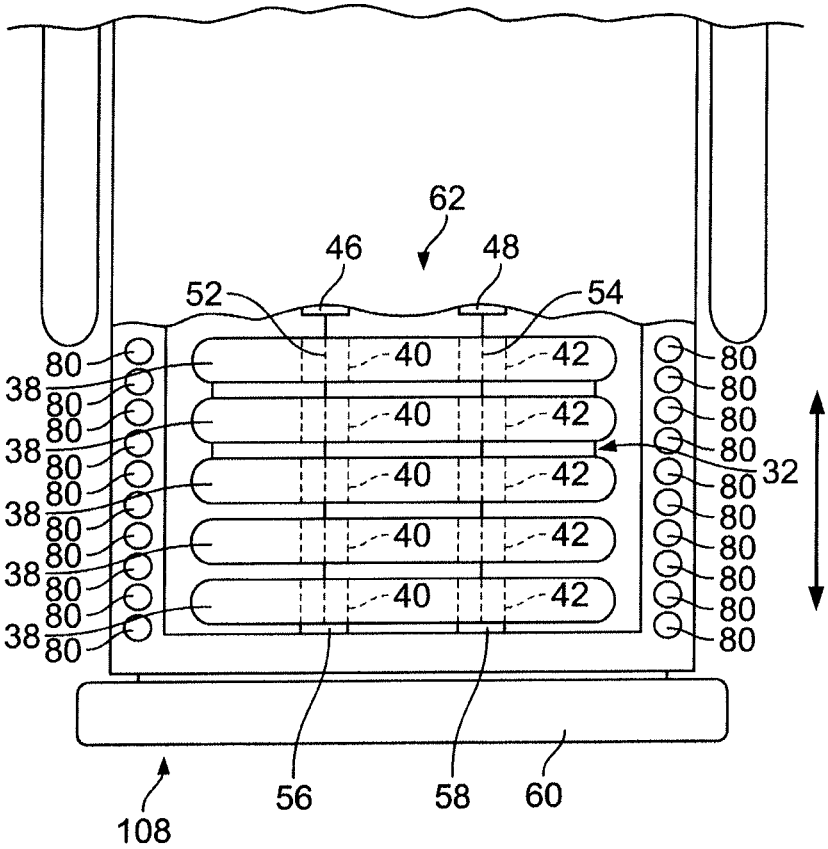
FIG. 5 is a top view of a foot end of the patient support apparatus of FIG. 1 with portions removed to expose the bladder assembly of the foot end of the mattress with the bladder assembly inflated.

In one illustrative embodiment, a bladder 38 includes two apertures 40 and 42 formed in a body 44 of the bladder 38. The body 44 of the bladder 38 supports the feet of a patient supported on the mattress 28. As shown in FIG. 5, the illustrative foot section bladder assembly 32 includes five bladders 38 which are arranged adjacent to one another so that each of the apertures 40 in the respective bladders 38 align to form a first passageway. Similarly, the apertures 42 in each of the respective bladders 38 form a second passageway. The mattress 28 includes a retraction management system 62 that includes two anchors 46 and 48 secured to a base 50 (seen in FIG. 7) of the mattress 28. An elastic tether 52 is secured to anchor 46 and is positioned in the apertures 40 of the bladders 38. A second elastic tether 54 is secured to the anchor 48 and is positioned in the apertures 42 of the adjacent bladders 38. The tether 52 is secured to a retainer 56 positioned on the foot end 108 side of the bladder 38 closest to the footboard 60. The tether 54 is secured to a retainer 58 positioned on the foot end 108 side of the bladder 38 closest to the footboard 60. The retainers 56 and 58 float relative to the remainder of the mattress 28.

Figure 6:
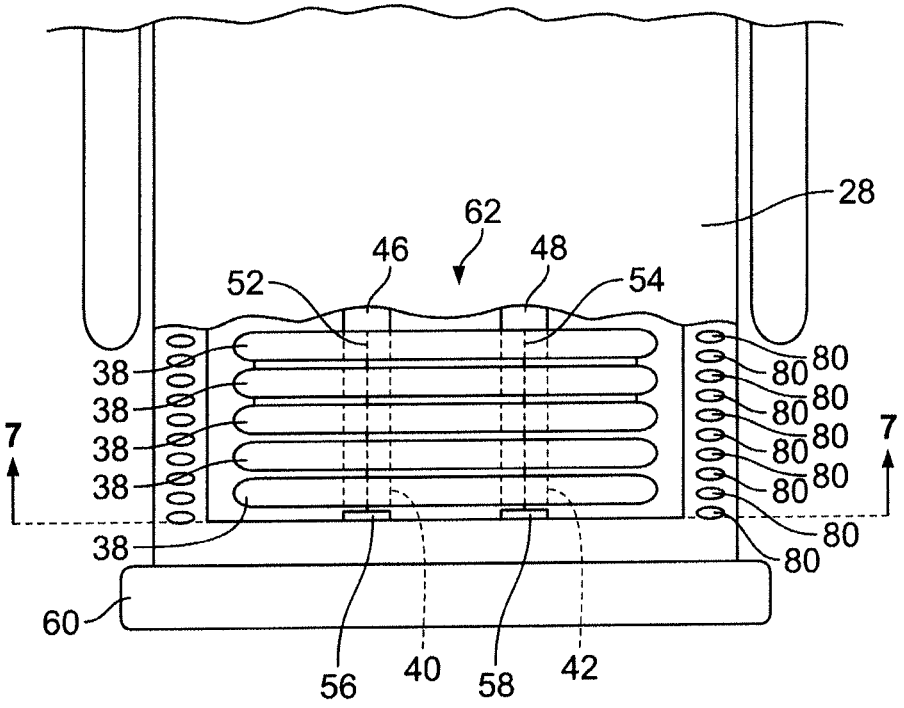
FIG. 6 is a top view of the bladder assembly of FIG. 5 with the bladder assembly partially inflated.

Referring now to FIG. 6, the tethers 52 and 54 act on the bladders 38 as they deflate to control the position and size of the bladders 38. Because all of the bladders 38 in the foot section bladder assembly 32 are in fluid communication with one another, they are all at the same pressure. The retainers 56 and 58 act on the bladder 38 closest to the footboard 60 to urge it against the next bladder 38. The tethers 52 and 54 provide constant force acting on the bladders 38, so that when the bladders 38 deflate, the foot section bladder assembly 32 remains in equilibrium with the tethers 52 and 54 to maintain the size and position of the bladders 38.

In the configuration shown in FIG. 6, the foot deck section 20 has been retracted and the foot section bladder assembly 32 has been allow to vent so that the volume of air in the foot section bladder assembly 32 is reduced. It should be noted, however, that the pressure in the foot section bladder assembly 32 is not necessarily reduced. The tension force of the tethers 52 and 54 results in a pressure acting on the bladders 38 that is less than the operational pressure of the foot section bladder assembly 32 such that the tethers do not appreciably increase the pressure in the bladders 38 and only control the position of the foot section bladder assembly 32.

Figure 7:
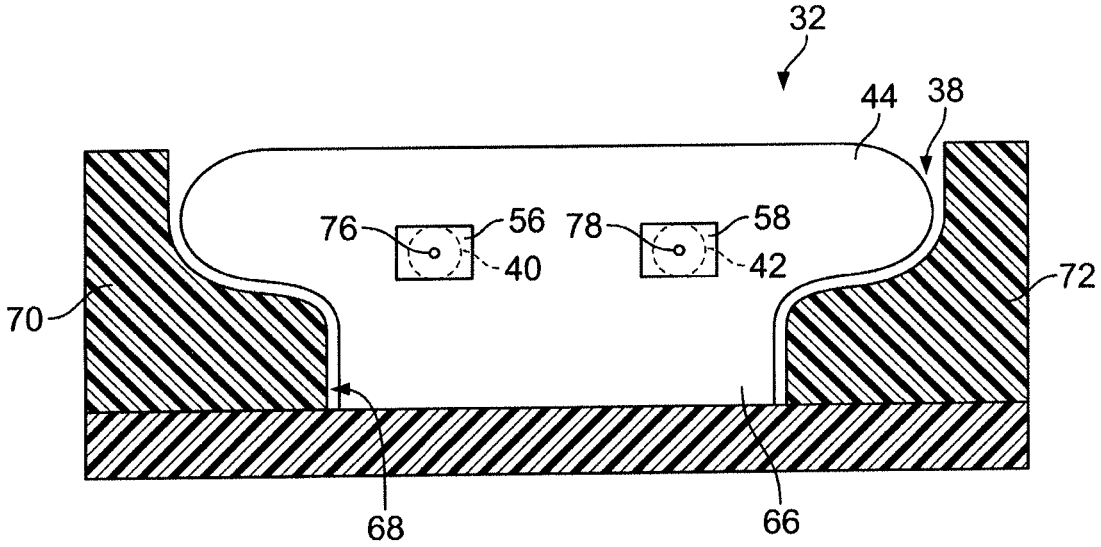
FIG. 7 is a cross-sectional view of the mattress of the patient support apparatus of FIG. 6 taken along lines 7-7 in FIG. 6.

Referring now to FIG. 7, the bladder 38 closest to the foot end 108 is viewed from the foot end 108 to show the retainers 56 and 58 acting no the bladder 38. The retainers 56 and 58 are polymer plates that engage the tethers 52 and 54 that pass through the apertures 40 and 42 and are secured to the plates 56 and 58 with fasteners 76 and 78, respectively. The bladder 38 includes the body 44 and a key 66 that is positioned in a channel 68 of the mattress 28. The mattress 28 illustratively includes foam sidewalls 70 and 72 and a foam base 50. The shape of the sidewalls 70, 72 and the channel 68 assist in maintaining the orientation of the bladder 38 in alignment with the longitudinal length of the mattress 28.

The sidewalls 70, 72 are each formed with a number of perforations 80 which are open spaces that collapse when the foot deck section 20 is retracted as shown in FIG. 6. Thus, the sidewalls 70 and 72 maintain the shape necessary to support and guide the bladders 38 as they contract. As can be seen in FIG. 7, the mattress is enclosed by a ticking 132 that encloses the components of the mattress 28.

Figure 8:
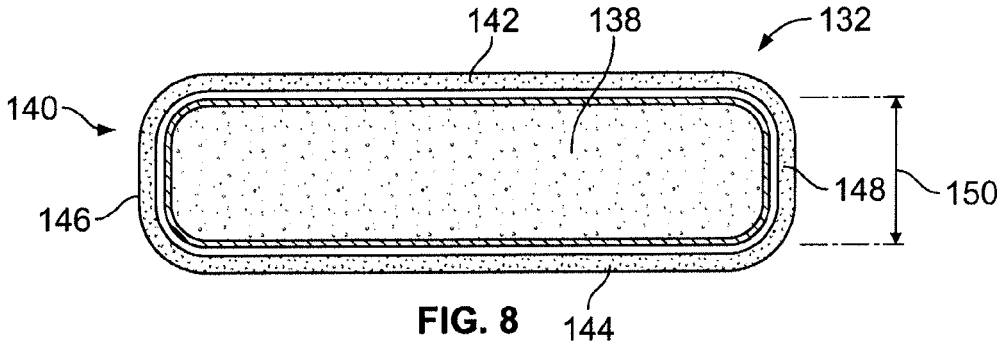
FIG. 8 a cross-sectional view of another embodiment of a mattress including a retraction management system.
Figure 9:
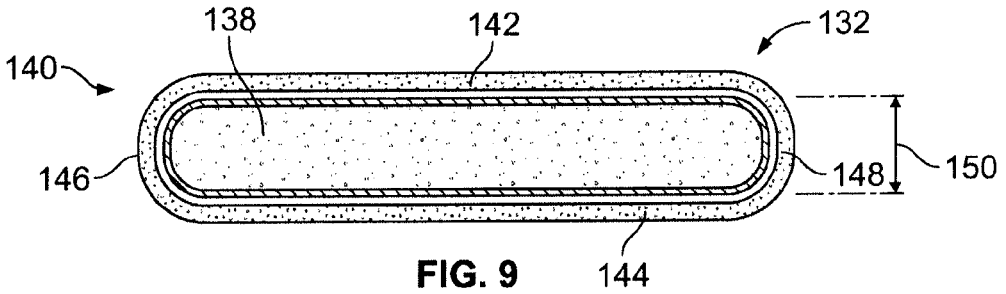
FIG. 9 is a view similar to FIG. 8 with the depth of the mattress reduced by the retraction management system.

In another embodiment of a bladder assembly 132, shown in FIGS. 8 and 9, a bladder 138 is enclosed by a retraction management system 140 that includes an upper retainer 142 and a lower retainer 144. The upper retainer 142 and lower retainer 144 are connected by a first bias member 146 and a second bias member 148 positioned on opposite sides of the bladder assembly 132. While only one bladder 138 is visible in FIGS. 8 and 9, it should be understood that several bladders 138 may be positioned adjacent one another similar to the configuration of foot section bladder assembly 32. When the volume of air in the bladder assembly 132 is reduced, the retraction management system 140 controls the location of the bladders 138 by holding the bladders 138 together and reducing the depth 150 of the bladder assembly 132 as shown in the change in depth 150 between FIG. 8 and FIG. 9. The bias members 146 and 148 develop a sufficient force to control the position of the bladders 138 as the bladder assembly 132 is deflated.

Figure 10:
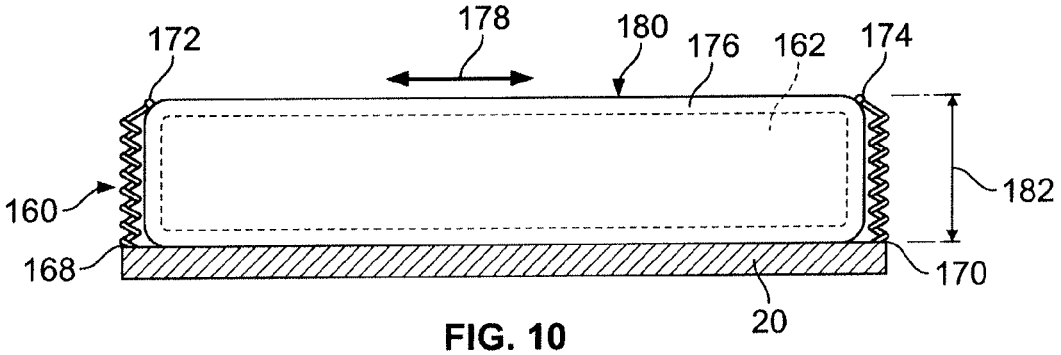
FIG. 10 is a cross-section view of yet another embodiment of a mattress including a retraction management system.
Figure 11:
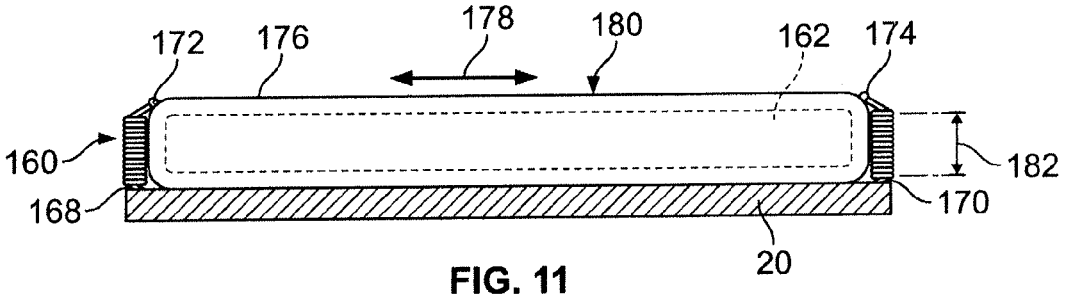
FIG. 11 is a view similar to FIG. 10 with the depth of the mattress reduced by the retraction management system.

In yet another embodiment shown in FIGS. 10 and 11, a retraction management system 160 for a bladder assembly 162 includes two bias members 164 and 166 positioned on opposite sides of a mattress 228. The retraction management system 160 also includes two anchors 168 and 170 that anchor the bias members 164 and 166 two the foot deck section 20. Two retainers 172 and 174 secure the bias members 164 and 166 to the ticking 176 of the mattress 228 so that a tension 178 is developed across the top surface 180 of the ticking 176. As the bladder assembly 162 is deflated, the bias members 164 and 166 draw the top surface 180 of the ticking 176 toward the foot deck section 20 so that the depth 182 of the mattress 228 is reduced. All of the excess materials are drawn in and contained between the top surface 180 of the ticking 176 and the bias members 164 and 166 so that the material is maintained in close proximity to the deck section 20.

In some embodiments, it is contemplated that the use of apertures through bladders as disclosed with regard to foot section bladder assembly 32 may be used in conjunction with the retraction management systems 140 and 160. Thus, a compound retraction management system may include a retraction management system similar to retraction management system 62 used in conjunction with a retraction management system 140 or 160 so that both the length of a bladder assembly and the depth of the bladder assembly may be controlled by the compound retraction management system.

Although certain illustrative embodiments have been described in detail above, variations and modifications exist within the scope and spirit of this disclosure as described and as defined in the following claims.

The invention claimed is:

1. A patient support apparatus comprising a source of pressurized air, an inflatable support structure including a bladder assembly in fluid communication with the source of pressurized air, and a retraction management system including a bias member acting on the inflatable support structure in equilibrium with the bladder assembly to control the size and position of the inflatable support structure during inflation and deflation of the bladder assembly, wherein the bladder assembly includes a plurality of adjacent bladders and the bias member passes through an aperture formed in each respective bladder, the bias member urging against a first one of the bladders and the first bladder acting on an adjacent bladder, with each successive bladder acting on an adjacent bladder to control the position and size of the bladder assembly during inflation and deflation of the bladder assembly.

2. The patient support apparatus of claim 1, wherein the patient support apparatus further includes a controller to control the source of pressurized air to vary the pressure in the bladder assembly.

3. The patient support apparatus of claim 1, wherein the bladder assembly has a length, a width, and a depth and the retraction management system includes an elastic fabric which acts on the bladder assembly to minimize the depth dimension.

4. The patient support apparatus of claim 3, wherein the retraction management system also acts on the bladder assembly to minimize the length dimension.

5. The patient support apparatus of claim 1, wherein the bladder assembly has a length, a width, and a depth and the retraction management system includes an elastic fabric which acts on the bladder assembly to minimize the length dimension.

6. The patient support apparatus of claim 5, wherein a bias member passes through an aperture formed in a bladder of the bladder assembly.

7. The patient support apparatus of claim 6, wherein the retraction management system further includes an anchor coupled to a first end of the bias member that passes through the aperture formed in a bladder of the bladder assembly.

8. The patient support apparatus of claim 7, wherein the retraction management system further includes a retainer coupled to a second end of the bias member that passes through the aperture formed in the bladder, the bias member urging the retainer against the bladder with the retainer urged toward the anchor to control the position and size of the bladder during inflation and deflation of the bladder.

9. The patient support apparatus of claim 1, wherein the retraction management system comprises a depth control assembly acting on the bladder assembly to manage the depth of the bladder assembly during inflation and deflation of the bladder assembly.

10. A patient support apparatus comprising a source of pressurized air, an inflatable support structure including a bladder assembly in fluid communication with the source of pressurized air, and a retraction management system including a bias member acting on the inflatable support structure in equilibrium with the bladder assembly to control the size and position of the inflatable support structure during inflation and deflation of the bladder assembly, wherein the bladder assembly has a length, a width, and a depth and the retraction management system includes an elastic fabric which acts on the bladder assembly to minimize the length dimension, wherein the retraction management system includes an anchor coupled to a first end of the bias member that passes through an aperture formed in a bladder of the bladder assembly, wherein the retraction management system includes a retainer coupled to a second end of the bias member that passes through an aperture formed in the bladder, the bias member urging the retainer against the bladder with the retainer urged toward the anchor to control the position and size of the bladder during inflation and deflation of the bladder, and wherein the bladder assembly includes a plurality of adjacent bladders and the bias member passes through an aperture formed in each respective bladder, the retainer urged against a first one of the bladders and the first bladder acting on an adjacent bladder, with each successive bladder acting on an adjacent bladder to control the position and size of the bladder assembly during inflation and deflation of the bladder assembly.

11. The patient support apparatus of claim 10, wherein each of the bladders is formed with a plurality of apertures such that the apertures in each bladder align with the apertures in adjacent bladders to form a path through the plurality of bladders and the retraction management system includes a plurality of bias members, each of the bias members passing through a separate path formed in the plurality of bladders.

12. The patient support apparatus of claim 11, wherein each of the bias members is coupled to an anchor and a retainer, each retainer acting on the bladder assembly to control the position and size of the bladder assembly during inflation and deflation of the bladder assembly.

13. The patient support apparatus of claim 12, wherein the patient support apparatus further comprises a variable length deck section having an actuator that extends and retracts to vary the length of the deck section and a controller coupled to the source of pressurized and the actuator, the controller coordinating the inflation and deflation of the bladder assembly with the extension and retraction of the actuator.

14. The patient support apparatus of claim 13, wherein the retraction management system further comprises a depth control assembly acting on the bladder assembly to manage the depth of the bladder assembly during inflation and deflation of the bladder assembly.

15. The patient support apparatus of claim 14, wherein the depth control assembly comprises an upper retainer that overlies the bladder assembly and a pair of bias members positioned on opposite lateral sides of the bladder assembly, the bias members urging the upper retainer to engage the bladder assembly to control the depth of the bladder assembly by maintaining equilibrium between the force exerted by the pressure in the bladder assembly and the force exerted by the depth control assembly.

16. The patient support apparatus of claim 15, wherein the depth control assembly further comprises a lower retainer, the bias members each secured at one end to the upper retainer and secured at the other end to the lower retainer, the bias members urging the retainers together to control the depth of the bladder assembly by maintaining equilibrium between the force exerted by the pressure in the bladder assembly and the force exerted by the depth control assembly.

17. The patient support apparatus of claim 15, wherein the bias members of the depth control assembly are each secured at one end to the upper retainer and at an opposite end to the deck.

18. A patient support apparatus comprising a source of pressurized air, an inflatable support structure including a bladder assembly in fluid communication with the source of pressurized air, and a retraction management system including a bias member acting on the inflatable support structure in equilibrium with the bladder assembly to control the size and position of the inflatable support structure during inflation and deflation of the bladder assembly, wherein the retraction management system comprises a depth control assembly acting on the bladder assembly to manage the depth of the bladder assembly during inflation and deflation of the bladder assembly, and wherein the depth control assembly comprises an upper retainer that overlies the bladder assembly and a pair of bias members positioned on opposite lateral sides of the bladder assembly, the bias member urging the upper retainer to engage the bladder assembly to control the depth of the bladder assembly by maintaining equilibrium between the force exerted by the pressure in the bladder assembly and the force exerted by the depth control assembly.

19. The patient support apparatus of claim 18, wherein the depth control assembly further comprises a lower retainer, the bias members each secured at one end to the upper retainer and secured at the other end to the lower retainer, the bias members urging the retainers together to control the depth of the bladder assembly by maintaining equilibrium between the force exerted by the pressure in the bladder assembly and the force exerted by the depth control assembly.

20. The patient support apparatus of claim 18, wherein the patient support apparatus further comprises a variable length deck section having an actuator that extends and retracts to vary the length of the deck section and a controller coupled to the source of pressurized and the actuator, the controller coordinating the inflation and deflation of the bladder assembly with the extension and retraction of the actuator and wherein the bias members of the depth control assembly are each secured at one end to the upper retainer and at an opposite end to the deck.

* * * * *